US011624254B2

(12) United States Patent
Nault et al.

(10) Patent No.: US 11,624,254 B2
(45) Date of Patent: Apr. 11, 2023

(54) ACCUMULATOR SYSTEM

(71) Applicant: Cameron International Corporation, Houston, TX (US)

(72) Inventors: Christopher Nault, Houston, TX (US); Matthew David Givens, Houston, TX (US); Vikas Rakhunde, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 148 days.

(21) Appl. No.: 16/543,738

(22) Filed: Aug. 19, 2019

(65) Prior Publication Data

US 2020/0056630 A1 Feb. 20, 2020

Related U.S. Application Data

(60) Provisional application No. 62/719,455, filed on Aug. 17, 2018.

(51) Int. Cl.

| | |
|---|---|
| ***E21B 33/064*** | (2006.01) |
| ***E21B 33/035*** | (2006.01) |
| ***E21B 33/06*** | (2006.01) |
| ***F15B 1/04*** | (2006.01) |
| ***H02K 7/06*** | (2006.01) |
| ***F04B 17/03*** | (2006.01) |
| ***F04B 23/02*** | (2006.01) |

(52) U.S. Cl.

CPC ..... *E21B 33/0355* (2013.01); *E21B 33/062* (2013.01); *E21B 33/064* (2013.01)

(58) Field of Classification Search

None

See application file for complete search history.

(56) References Cited

U.S. PATENT DOCUMENTS 5,505,426 A * 4/1996 Whitby ..... E21B 33/063 251/1.3
6,202,753 B1 3/2001 Baugh
6,234,771 B1 * 5/2001 Carey ..... F04B 17/03 417/415
6,998,724 B2 2/2006 Johansen et al.
7,137,450 B2 * 11/2006 Johansen ..... E21B 33/0355 166/316
7,156,183 B2 1/2007 Williams (Continued)

FOREIGN PATENT DOCUMENTS

EP 2917461 A1 9/2015
EP 3502410 A1 6/2019

(Continued)

OTHER PUBLICATIONS

Quam SC-SSV control line blow out preventer product sheet.*

(Continued)

*Primary Examiner* — Matthew Troutman
*Assistant Examiner* — Douglas S Wood
(74) *Attorney, Agent, or Firm* — Kelly McKinney

(57) ABSTRACT

An accumulator system that includes a housing. The housing defines a function chamber and a balance chamber. A piston moves axially within the housing. The piston separates the function chamber from the balance chamber. An electric actuator couples to and drives the piston within the housing to compress and drive a first fluid out of the function chamber.

12 Claims, 5 Drawing Sheets

(56) References Cited

U.S. PATENT DOCUMENTS

| | | | | |
|---|---|---|---|---|
| 7,159,662 | B2 * | 1/2007 | Johansen | E21B 34/16 166/374 |
| 7,520,129 | B2 | 4/2009 | Springett | |
| 7,878,244 | B2 | 2/2011 | Nold, III et al. | |
| 8,657,011 | B2 | 2/2014 | Vyas et al. | |
| 8,784,074 | B2 | 7/2014 | Davey et al. | |
| 9,140,090 | B2 | 9/2015 | Van Wijk et al. | |
| 9,222,326 | B2 | 12/2015 | Whitby et al. | |
| 9,388,888 | B2 | 7/2016 | Eriksen | |
| 9,494,007 | B2 | 11/2016 | Bourgeau et al. | |
| 9,587,455 | B2 | 3/2017 | Frey et al. | |
| 9,627,940 | B2 | 4/2017 | Eriksen | |
| 9,822,600 | B2 | 11/2017 | Bourgeau et al. | |
| 9,885,221 | B2 * | 2/2018 | Baugh | E21B 33/063 |
| 9,957,768 | B2 | 5/2018 | Van Wijk et al. | |
| 10,132,135 | B2 | 11/2018 | Gaude | |
| 10,316,605 | B2 | 6/2019 | Bourgeau et al. | |
| 10,365,669 | B2 | 7/2019 | Groves et al. | |
| 10,851,805 | B2 | 12/2020 | Thomson et al. | |
| 10,975,891 | B2 * | 4/2021 | Afshari | F04B 23/02 |
| 2013/0019980 | A1 | 1/2013 | Baugh | |
| 2013/0283919 | A1 * | 10/2013 | Coonrod | E21B 33/06 73/632 |
| 2014/0027105 | A1 | 1/2014 | Irani | |
| 2014/0166264 | A1 * | 6/2014 | Judge | E21B 33/063 166/66 |
| 2014/0325974 | A1 | 11/2014 | Schulz et al. | |
| 2015/0104328 | A1 | 4/2015 | Babbitt et al. | |
| 2015/0211504 | A1 | 7/2015 | Dieringer et al. | |
| 2018/0347304 | A1 | 12/2018 | Alalasundaram et al. | |
| 2019/0003275 | A1 * | 1/2019 | Deul | E21B 33/0355 |
| 2019/0203739 | A1 | 7/2019 | Afshari | |
| 2019/0218879 | A1 | 7/2019 | Biester et al. | |
| 2020/0072012 | A1 | 3/2020 | Angstmann et al. | |

FOREIGN PATENT DOCUMENTS

| | | | |
|---|---|---|---|
| WO | 2012140178 | A1 | 10/2012 |
| WO | 2017042152 | A1 | 3/2017 |
| WO | 2017062040 | A1 | 4/2017 |

OTHER PUBLICATIONS

Quantum Leap Technologies, Integrated Power Solutions, https://www.qltech.net/, Westhill, UK, 2019.

International Search Report and Written Opinion issued in International Patent Application No. PCT/US2021/017651 dated Jun. 4, 2021; 10 pages.

International Preliminary Report on Patentability issued in the PCT Application No. PCT/US2021/017651 dated Aug. 25, 2022, 7 pages.

* cited by examiner

ACCUMULATOR SYSTEM

BACKGROUND

This application claims priority from and the benefit of U.S. Provisional Application Ser. No. 62/719,455, entitled "Force Driven Accumulator," filed Aug. 17, 2018, which is herein incorporated by reference in its entirety for all purposes.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

In order to meet consumer and industrial demand for natural resources, companies often invest significant amounts of time and money in searching for and extracting oil, natural gas, and other subterranean resources from the earth. Once a desired subterranean resource is discovered, drilling and production systems are employed to access and extract the resource. These systems may be located onshore or offshore depending on the location of the desired resource. Such systems generally include a wellhead assembly through which the resource is extracted. These wellhead assemblies may include a wide variety of components, such as various casings, valves, fluid conduits, that control drilling or extraction operations.

Deepwater accumulators provide a supply of pressurized working fluid for the control and operation of sub-sea equipment, such as through hydraulic actuators and motors. Typical sub-sea equipment may include, but is not limited to, blowout preventers (BOPs) that shut off the well bore, gate valves for flow control of oil or gas, electro-hydraulic control pods, or hydraulically-actuated connectors and similar devices.

SUMMARY

Certain aspects of some embodiments disclosed herein are set forth below. It should be understood that these aspects are presented merely to provide the reader with a brief summary of certain forms the disclosure might take and that these aspects are not intended to limit the scope of the disclosure. Indeed, the disclosure may encompass a variety of aspects that may not be set forth below.

In one example, an accumulator system that includes a housing. The housing defines a function chamber and a balance chamber. A piston moves axially within the housing. The piston separates the function chamber from the balance chamber. An electric actuator couples to and drives the piston within the housing to compress and drive a first fluid out of the function chamber.

In another example, a mineral extraction system that includes a mineral extraction component. An accumulator system couples to the mineral extraction component. The accumulator system pressurizes a fluid to actuate the mineral extraction component. The accumulator system includes a housing. The housing defines a function chamber and a balance chamber. A piston moves axially within the housing. The piston separates the function chamber from the balance chamber. An electric actuator couples to and drives the piston within the housing to compress and drive a first fluid out of the function chamber.

In another example, an accumulator system that includes a cylinder that receives a first fluid. An actuator housing couples to the cylinder. A piston moves within the cylinder to pressurize and drive the first fluid out of the cylinder. A shaft couples to the piston. A screw adapter couples to the shaft. An electric motor couples to the screw adapter. The electric motor rotates the screw adapter to axially move the shaft.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
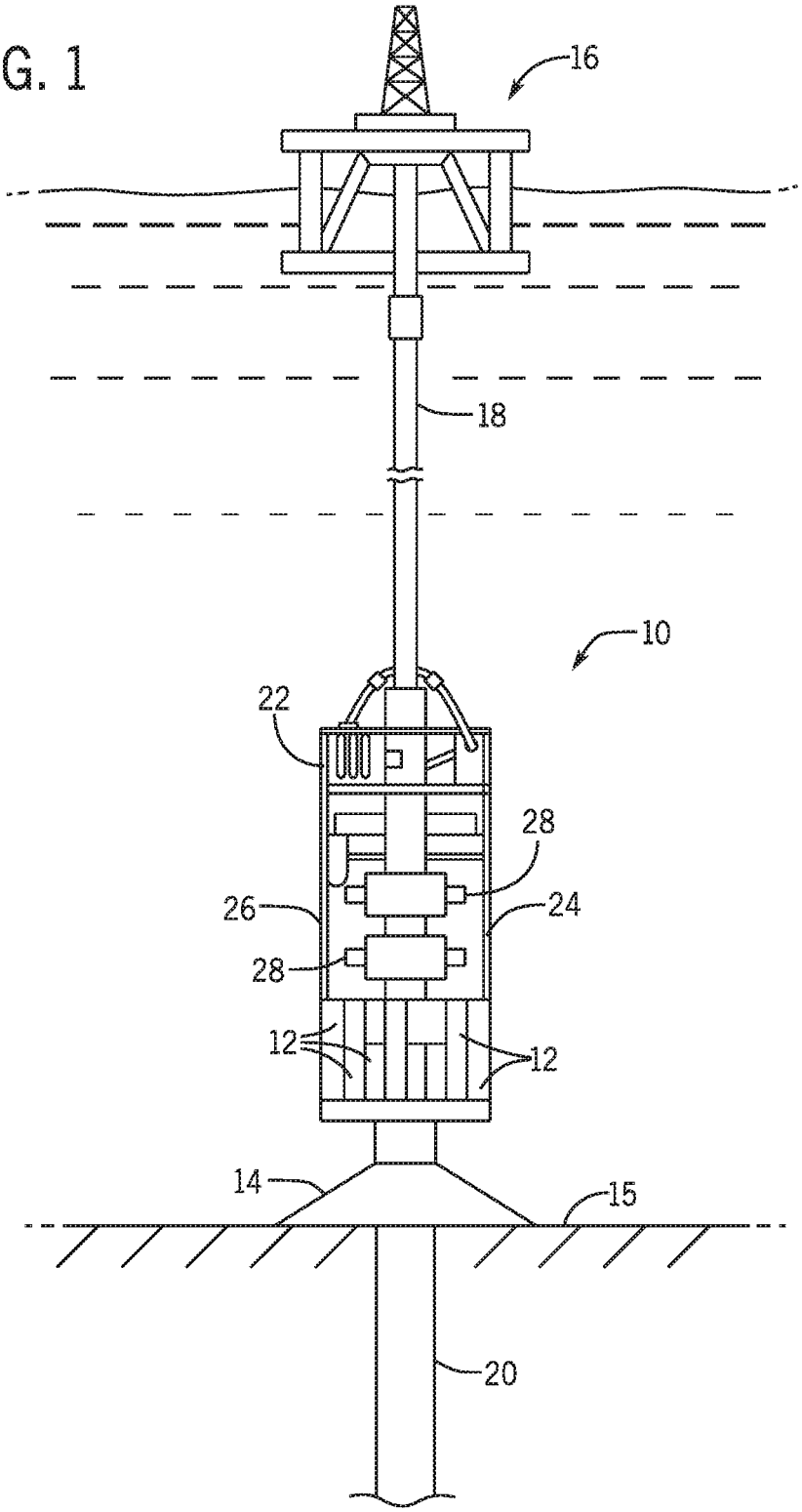
FIG. 1 is a schematic of a sub-sea BOP stack assembly having one or accumulator systems, in accordance with an embodiment of the present disclosure.

Certain embodiments commensurate in scope with the present disclosure are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

As used herein, the term "coupled" or "coupled to" may indicate establishing either a direct or indirect connection, and is not limited to either unless expressly referenced as such. The term "set" may refer to one or more items. Wherever possible, like or identical reference numerals are used in the figures to identify common or the same elements. The figures are not necessarily to scale and certain features and certain views of the figures may be shown exaggerated in scale for purposes of clarification.

Furthermore, when introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

Typical accumulators may be divided into a gas section and a hydraulic fluid section that operate on a common principle. The general principle is to pre-charge the gas section with pressurized gas to a pressure at or slightly below the anticipated minimum pressure to operate the sub-sea equipment. Fluid can be added to the accumulator in the separate hydraulic fluid section, compressing the gas section, thus increasing the pressure of the pressurized gas and the hydraulic fluid together. The hydraulic fluid introduced into the accumulator is therefore stored at a pressure equivalent to the pre-charge pressure and is available for doing hydraulic work. However, gas-charged accumulators used in sub-sea environments may undergo a decrease in efficiency as water depth increases. This loss of efficiency is due, at least in part, to an increase of hydrostatic stress acting on the pre-charged gas section, which provides the power to the accumulators through the compressibility of the gas.

The pre-charge gas can be said to act as a spring that is compressed when the gas section is at its lowest volume and greatest pressure, and released when the gas section is at its greatest volume and lowest pressure. Accumulators may be pre-charged in the absence of hydrostatic pressure and the pre-charge pressure may be limited by the pressure containment and structural design limits of the accumulator vessel under surface ambient conditions. Yet, as described above, as accumulators are used in deeper water, their efficiency decreases as application of hydrostatic pressure causes the gas to compress, leaving a progressively smaller volume of gas to charge the hydraulic fluid. The gas section must consequently be designed such that the gas still provides enough power to operate the sub-sea equipment under hydrostatic pressure even as the hydraulic fluid approaches discharge and the gas section is at its greatest volume and lowest pressure.

For example, accumulators at the surface may provide 3,000 psi (pounds per square inch) maximum working fluid pressure. In 1,000 feet of seawater, the ambient pressure is approximately 465 psi. Therefore, for an accumulator to provide a 3,000 psi differential at the 1,000 foot depth, it must actually be pre-charged to 3,000 psi plus 465 psi, or 3,465 psi. At slightly over 4,000 feet water depth, the ambient pressure is almost 2,000 psi. Therefore, the pre-charge would be required to be 3,000 psi plus 2,000 psi, or 5,000 psi. In others words, the pre-charge would be almost double the working pressure of the accumulator. Thus, at progressively greater hydrostatic operating pressures, the accumulator has greater pressure containment requirements at non-operational (e.g., no ambient hydrostatic pressure) conditions.

Given the limited structural capacity of the accumulator to contain the gas pre-charge, operators of this type of equipment may be forced to work within efficiency limits of the systems. For example, when deep water systems are required to utilize hydraulic accumulators, operators will often add additional accumulators to the system. Some accumulators may be charged to 500 psi, 2,000 psi, 5,000 psi, or higher, based on system requirements. As the equipment is initially deployed in the water, all accumulators may operate normally. However, as the equipment is deployed in deeper water (e.g., past 1,000 feet), the accumulators with the 500 psi pre-charge may become inefficient due to the hydrostatic compression of the gas charge. Additionally, the hydrostatic pressure may act on all the other accumulators, decreasing their efficiency. The decrease in efficiency of the sub-sea gas charged accumulators decreases the amount and rate of work which may be performed at deeper water depths. As such, for sub-sea equipment designed to work beyond 5,000 foot water depth, the amount of gas charged accumulators may be increased by 5 to 10 times. The addition of these accumulators increases the size, weight, and complexity of the sub-sea equipment.

Conversely, the disclosed embodiments do not rely on gas to provide power to a working fluid. Rather, the accumulator systems include an electric actuator that drives a piston to pressurize a working fluid that then actuates one or more mineral extraction system components (e.g., blowout preventer). This means that the accumulator systems discussed below may not experience a loss in efficiency due to water depth. Additionally, the accumulator systems discussed below vary pressure output since the electric actuator may be controlled in response to pressure demands of the mineral extraction system or component.

FIG. 1 depicts a sub-sea BOP stack assembly 10, which may include one or more accumulator systems 12 that power one or more components on the sub-sea BOP stack assembly 10. As illustrated, the BOP stack assembly 10 may be assembled onto a wellhead assembly 14 on the sea floor 15. The BOP stack assembly 10 may be connected in line between the wellhead assembly 14 and a floating rig 16 through a sub-sea riser 18. The BOP stack assembly 10 may provide emergency fluid pressure containment in the event that a sudden pressure surge escapes the well bore 20. Therefore, the BOP stack assembly 10 may be configured to prevent damage to the floating rig 16 and the sub-sea riser 18 from fluid pressure exceeding design capacities. The BOP stack assembly 10 may also include a BOP lower marine riser package 22, which may connect the sub-sea riser 18 to a BOP package 24.

In certain embodiments, the BOP package 24 may include a frame 26, BOPs 28, and accumulator systems 12, which may be used to provide hydraulic fluid pressure for actuating the BOPs 28. The accumulator systems 12 may be incorporated into the BOP package 24 to maximize the available space and leave maintenance routes clear for working on components of the sub-sea BOP package 24. The accumulator systems 12 may be installed in parallel where the failure of any single accumulator system 12 may prevent the additional accumulator systems 12 from functioning.

Figure 2:
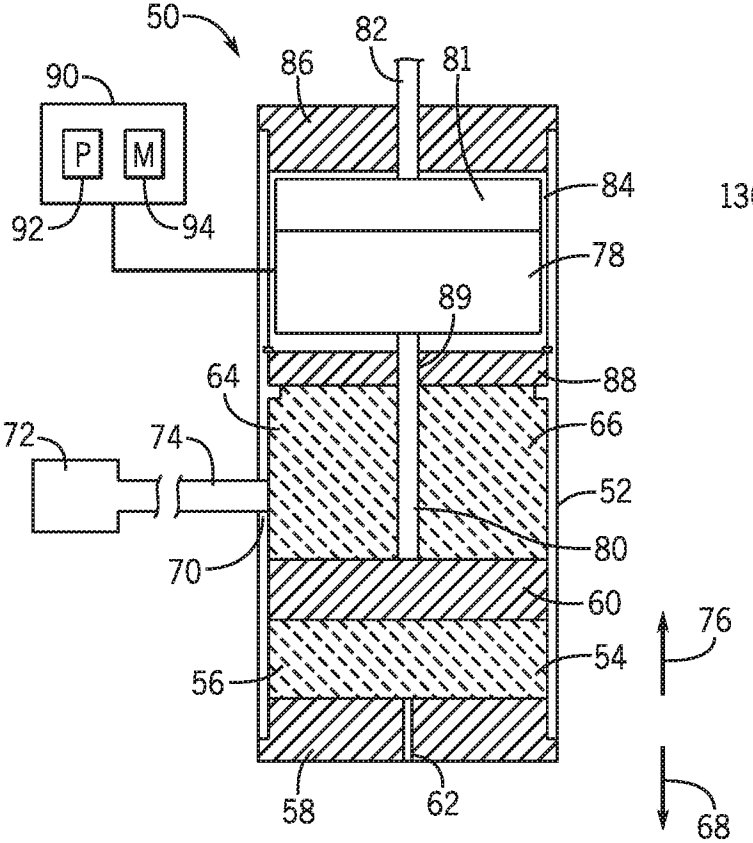
FIG. 2 is a schematic of an accumulator system, in accordance with an embodiment of the present disclosure.

FIG. 2 is a schematic of an accumulator system 50. The accumulator system 50 includes a body or housing 52 that houses a working fluid 54 that is used to power or drive operation of another system or component (e.g., blowout preventer). The working fluid 54 is stored in a function chamber 56 (e.g., cavity) formed by a first end cap 58 and a piston 60. The first end cap 58 (e.g., housing end cap) defines one or more apertures 62 (e.g., 1, 2, 3, 4, 5 or more) that enable the working fluid to flow through the first end cap 58. To block or reduce formation of a hydraulic lock on the piston 60, the housing 52 includes a balance chamber 64 (e.g., cavity). The balance chamber 64 receives a balance fluid 66 (e.g., oil, hydraulic fluid, water, seawater) that enters the balance chamber 64 as the piston 60 moves in direction 68. The balance chamber 64 may receive the balance fluid 66 through one or more apertures 70 in the housing 52 from an external supply 72 or a fluid surrounding the housing 52 (e.g., seawater). For example, the external supply 72 may store oil, hydraulic fluid, water, etc., which flows through a conduit 74 and into the balance chamber 64. The balance fluid 66 may be pumped into the balance chamber 64 or it may be drawn into the balance chamber 64 by the movement of the piston 60 in direction 68.

The piston 60 moves in directions 68 and 76 in response to an actuator 78 that pulls and pushes the shaft 80 in directions 76 and 68. For example, the actuator 78 may be an electric motor. The actuator 78 may be powered with one or more batteries 81 and/or with electric power supplied from an external power source 82. For example, during operation the battery 81 may power the actuator 78, after which the battery 81 is recharged from an external power source 82. The external power source 82 may couple to the actuator 78 with a cable that extends through the housing 52. The actuator 78 and/or battery 81 rest within an actuator chamber 84 (e.g., cavity) defined by the housing 52. The actuator chamber 84 is separated from the exterior environment and from the balance chamber 64 with a second end cap 86 (e.g., housing end cap) and an enclosure cap 88. As illustrated, the enclosure cap 88 defines an aperture 89 that enables the shaft 80 to couple to the actuator 78.

In order to control the operation of the actuator 78, the accumulator system 50 includes a controller 90. The controller 90 includes a processor 92 and a memory 94. For example, the processor 92 may be a microprocessor that executes software to control operation of the actuator 78. The processor 92 may include multiple microprocessors, one or more "general-purpose" microprocessors, one or more special-purpose microprocessors, and/or one or more application specific integrated circuits (ASICs), field-programmable gate arrays (FPGAs), or some combination thereof. For example, the processor 92 may include one or more reduced instruction set (RISC) processors.

The memory 94 may include a volatile memory, such as random access memory (RAM), and/or a nonvolatile memory, such as read-only memory (ROM). The memory 94 may store a variety of information and may be used for various purposes. For example, the memory 94 may store processor executable instructions, such as firmware or software, for the processor 92 to execute. The memory 94 may include ROM, flash memory, a hard drive, or any other suitable optical, magnetic, or solid-state storage medium, or a combination thereof. The memory 94 may store data, instructions, and any other suitable data.

Figure 3:
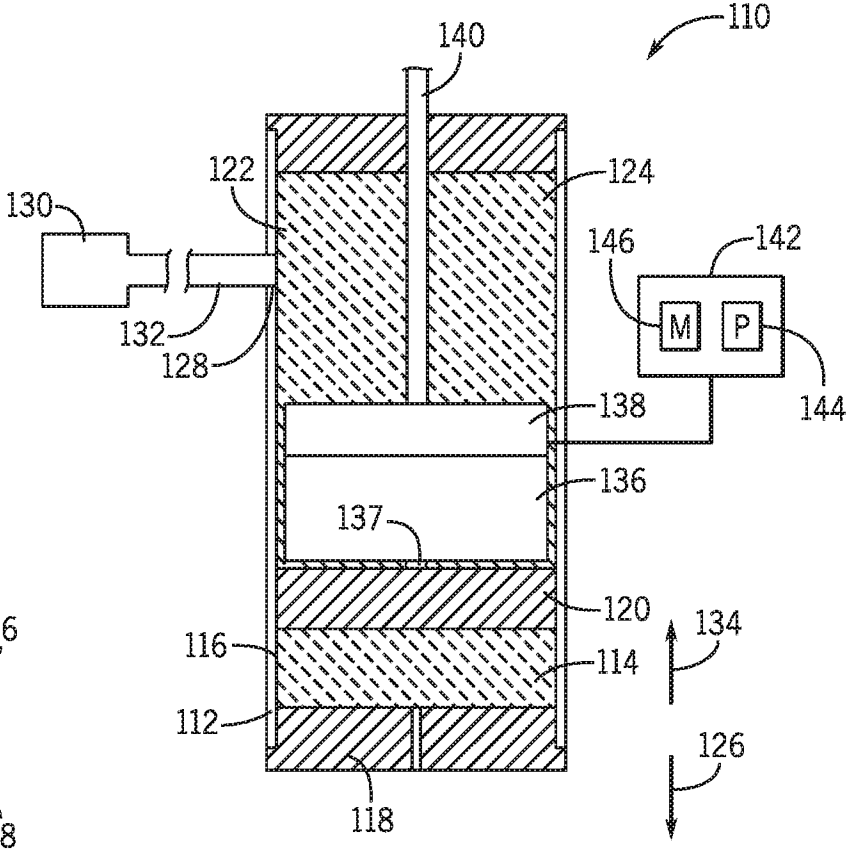
FIG. 3 is a schematic of an accumulator system, in accordance with an embodiment of the present disclosure.

FIG. 3 is a schematic of an accumulator system 110. The accumulator system 110 includes a body or housing 112 that houses a working fluid 114 used to power or drive operation of another system or component (e.g., blowout preventer). The working fluid 114 is stored in a function chamber 116 (e.g., cavity) formed by a first end cap 118 and a piston 120. The first end cap 118 (e.g., housing end cap) defines one or more apertures (e.g., 1, 2, 3, 4, 5 or more) that enable the working fluid to flow through the first end cap 118. To block or reduce formation of a hydraulic lock, the housing 112 includes a balance chamber 122 (e.g., cavity). The balance chamber 122 receives a balance fluid 124 (e.g., oil, hydraulic fluid, water, seawater) that enters the balance chamber 122 as the piston 120 moves in direction 126. The balance chamber 122 may receive the balance fluid 124 through one or more apertures 128 in the housing 112 from an external supply 130 or a fluid surrounding the housing 112 (e.g., seawater). For example, the external supply 130 may store oil, hydraulic fluid, water, etc., which flows through a conduit 132 and into the balance chamber 122. The balance fluid 124 may be pumped into the balance chamber 122 or it may be drawn into the balance chamber 122 by the movement of the piston 120 in direction 126.

The piston 120 moves in directions 126 and 134 in response to an actuator 136 that pulls and pushes the shaft 137 in directions 126 and 134. For example, the actuator 136 may be an electric motor. The actuator 136 may be powered with one or more batteries 138 and/or with electric power supplied from an external power source 140. The external power source 140 may couple to the actuator 136 with a cable that extends through the housing 112. As illustrated, the actuator 136 and/or battery 138 rest within the balance chamber 122 and are therefore surrounded by the balance fluid 124. In order to control operation of the actuator 136, the accumulator system 110 includes a controller 142. The controller 142 includes a processor 144 and a memory 146. For example, the processor 144 may be a microprocessor that executes software stored on the memory 146 to control operation of the actuator 136. The processor 144 may include multiple microprocessors, one or more "general-purpose" microprocessors, one or more special-purpose microprocessors, and/or one or more application specific integrated circuits (ASICs), field-programmable gate arrays (FPGAs), or some combination thereof. For example, the processor 144 may include one or more reduced instruction set (RISC) processors.

The memory 146 may include a volatile memory, such as random access memory (RAM), and/or a nonvolatile memory, such as read-only memory (ROM). The memory 146 may store a variety of information and may be used for various purposes. For example, the memory 146 may store processor executable instructions, such as firmware or software, for the processor 144 to execute. The memory 146 may include ROM, flash memory, a hard drive, or any other suitable optical, magnetic, or solid-state storage medium, or a combination thereof. The memory 146 may store data, instructions, and any other suitable data.

Figure 4:
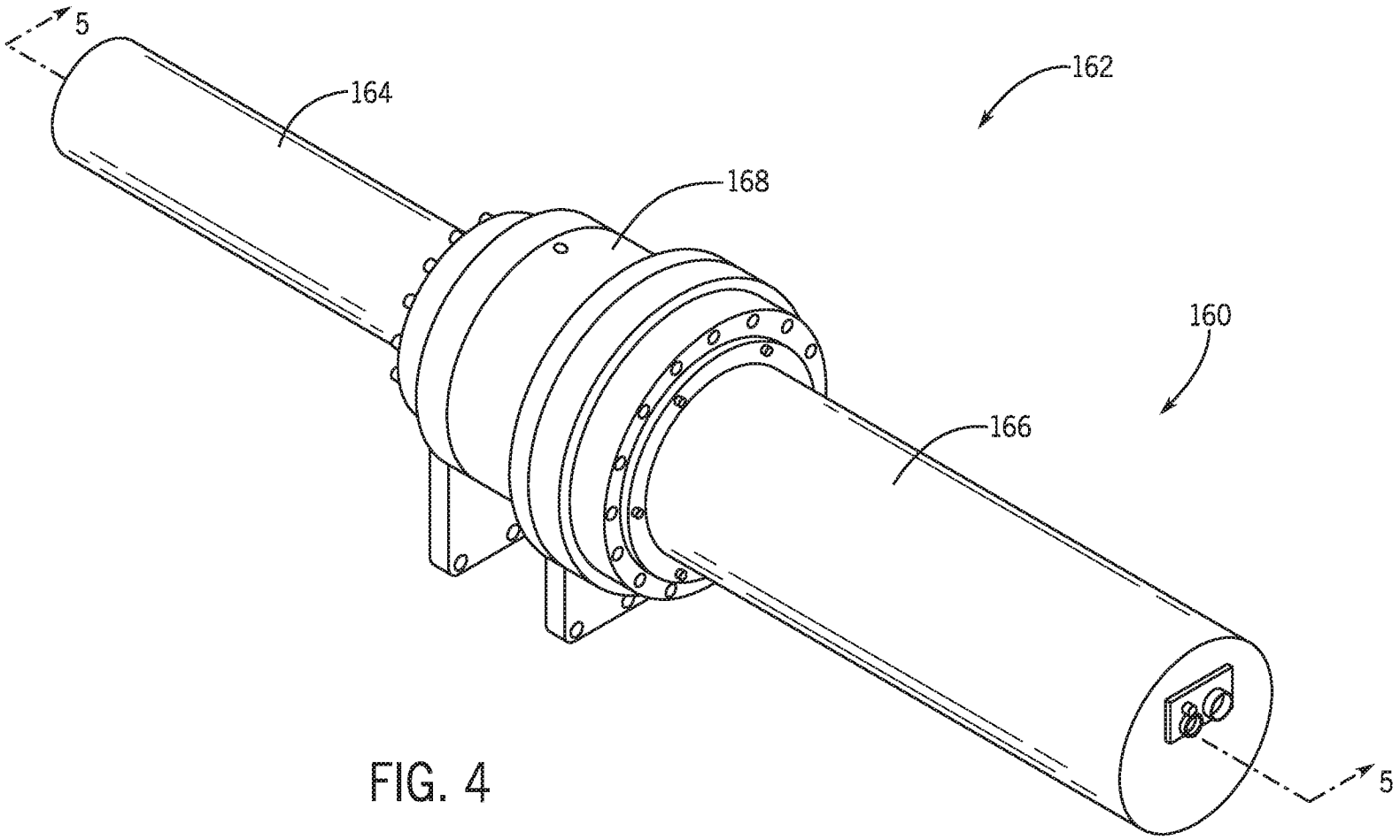
FIG. 4 is a perspective view of an accumulator system, in accordance with an embodiment of the present disclosure.

FIG. 4 is a perspective view of an accumulator system 160 that enables storage of a fluid (e.g., working fluid) at ambient pressure (e.g., ambient pressure in a subsea environment). The accumulator system 160 includes a housing 162. The housing 162 includes a first cylinder 164 and a second cylinder 166 that couple to an actuator housing 168. In operation, the accumulator system 160 enables on demand pressurization of the fluid (e.g., working fluid) in the first cylinder 164. The pressurization of the fluid drives the fluid out of the first cylinder 164 to power or drive operation of another system or component (e.g., blowout preventer). As will be explained below, the second cylinder 166 may house various components that facilitate operation of the accumulator system 160.

Figure 5:
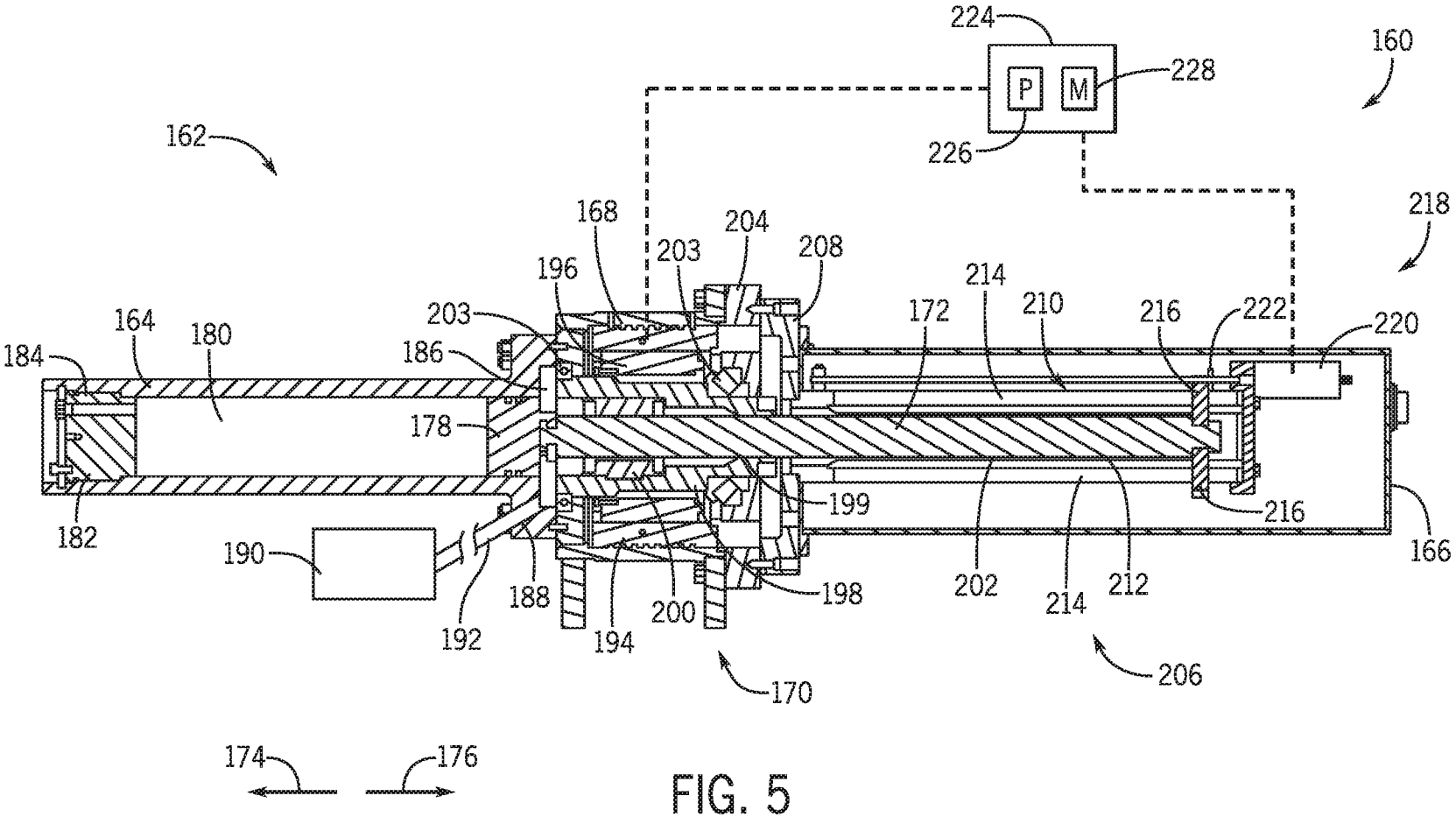
FIG. 5 is a cross-sectional view along line 5-5 in FIG. 4 of the accumulator system in an unactuated state, in accordance with an embodiment of the present disclosure.

FIG. 5 is a cross-sectional view along line 5-5 in FIG. 4 of the accumulator system 160 in an unactuated state. As explained above, the accumulator system 160 includes the first cylinder 164 and the second cylinder 166 that couple to an actuator housing 168. The actuator housing 168 houses an actuator 170 (e.g., electric motor) that drives a shaft 172 in directions 174 and 176 to extend and retract a piston 178. As the piston 178 moves in direction 174, the piston 178 pressurizes a working fluid (e.g., hydraulic fluid) stored in a function chamber 180 (e.g., cavity) of the accumulator system 160. As the working fluid pressurizes, the working fluid exits the accumulator system 160 and flows through the end cap 182. The end cap 182 defines one or more apertures (e.g., 1, 2, 3, 4, 5 or more) that enable the working fluid to flow through the end cap 182.

To block or reduce formation of a hydraulic lock on the piston 178, the first cylinder 164 may include a balance chamber 186 (e.g., cavity). In some embodiments, the actuator housing 168 and the first cylinder 164 may form the balance chamber 186. The balance chamber 186 receives a balance fluid 66 (e.g., oil, hydraulic fluid, water, seawater)

that enters the balance chamber 186 as the piston 178 moves in direction 174. The balance chamber 186 may receive the balance fluid through one or more apertures 188 in the first cylinder 164 and/or the actuator housing 168. The balance fluid may be supplied from an external supply 190 or a fluid surrounding the accumulator system 160 (e.g., seawater). For example, the external supply 190 may store oil, hydraulic fluid, water, etc., which flows through a conduit 192 and into the balance chamber 186. The balance fluid may be pumped into the balance chamber 186 or it may be drawn into the balance chamber 186 by the movement of the piston 178 in direction 174.

As illustrated, the actuator 170 is an electric motor with a stator 194 and a rotor 196 that includes magnets (e.g., electromagnets, permanent magnets, combinations of electromagnets and permanent magnets). In operation, the rotor 196 rotates in response to electrical power supplied to the magnets of the stator 194 and/or the rotor 196. As the rotor 196 rotates, the rotor 196 rotates a screw adapter 198. The screw adapter 198 defines an aperture 199 that enables the shaft 172 to extend through the screw adapter 198. In some embodiments, the screw adapter 198 receives a plurality of roller screws 200 in the aperture 199. As the screw adapter 198 rotates, the plurality of roller screws 200 rotate. The rollers screws 200 engage an exterior threaded surface 202 of the shaft 172. As the roller screws 200 rotate they drive the shaft 172 axially in directions 174 and 176. In some embodiments, the screw adapter 198 may define a threaded surface that directly engages the shaft 172 to drive the shaft 172 in axial directions 174 and 176.

To facilitate rotation of the screw adapter 198, the accumulator system 160 may include one or more bearings 203 (e.g., thrust bearings). As illustrated, the bearings 203 may be placed between the screw adapter 198 and the actuator housing 168, as well as between the screw adapter 198 and a retention plate 204. The retention plate 204 couples to the actuator housing 168 to block removal of the stator 194, rotor 196, and screw adapter 198. The retention plate 204 may also hold the bearings 203 in position relative to the screw adapter 198.

In order to block rotation of the shaft 172, the accumulator system 160 may include an anti-rotation system 206. The anti-rotation system 206 may include an anti-rotation flange 208 (e.g., plate) that couples to the retention plate 204. The anti-rotation flange 208 in turn couples to an anti-rotation housing 210 (e.g., cylinder, block). The anti-rotation housing 210 defines a cavity 212 that receives the shaft 172 and one or more slits 214 (e.g., apertures) that receive anti-rotation guides 216. The anti-rotation guides 216 may be protrusions (e.g., integral, one-piece) that extend radially outward from the shaft 172 and/or blocks that extend radially outward from the shaft 172 and that separately couple to the shaft 172. The anti-rotation guides 216 extend into the slits 214 and block rotation of the shaft 172 by contacting the anti-rotation housing 210.

In some embodiments, the accumulator system 160 may include a position detection system 218 that enables detection of the position of the shaft 172. The position detection system 218 includes a position sensor 220 (e.g., magnetic field sensor) that senses the strength of a magnetic field created by a magnet 222. The magnet 222 couples to the anti-rotation guides 216 and therefore moves axially in directions 174 and 176 as the shaft 172 moves. In some embodiments, the anti-rotation guides 216 may be made out of a magnetic material. As the magnet 222 moves in direction 174 the strength of the magnetic field created by the magnet 222 decreases. Likewise, movement of the magnet 222 in direction 176 increases the strength of the magnetic field relative to the position sensor 220. The change in magnetic field strength is sensed by the position sensor 220 and transmitted to a controller 224 as a signal indicative of the detected magnetic field strength. The controller 224 receives this signal and determines the relative position of the magnet 222 relative to the position sensor 220 to determine the position of the shaft 172. In some embodiments, the position detection system 218 may include an ultrasonic sensor that enables detection of changes in the shaft position 172. For example, the position sensor 220 may emit a signal that is reflected off a plate coupled to the anti-rotation guides and/or off the anti-rotation guides 216.

The controller 224 includes a processor 226 and a memory 228. For example, the processor 226 may be a microprocessor that executes software stored on the memory 228 to control operation of the accumulator system 160. The processor 226 may include multiple microprocessors, one or more "general-purpose" microprocessors, one or more special-purpose microprocessors, and/or one or more application specific integrated circuits (ASICs), field-programmable gate arrays (FPGAs), or some combination thereof. For example, the processor 226 may include one or more reduced instruction set (RISC) processors.

The memory 228 may include a volatile memory, such as random access memory (RAM), and/or a nonvolatile memory, such as read-only memory (ROM). The memory 228 may store a variety of information and may be used for various purposes. For example, the memory 228 may store processor executable instructions, such as firmware or software, for the processor 226 to execute. The memory 228 may include ROM, flash memory, a hard drive, or any other suitable optical, magnetic, or solid-state storage medium, or a combination thereof. The memory 228 may store data, instructions, and any other suitable data.

Figure 6:
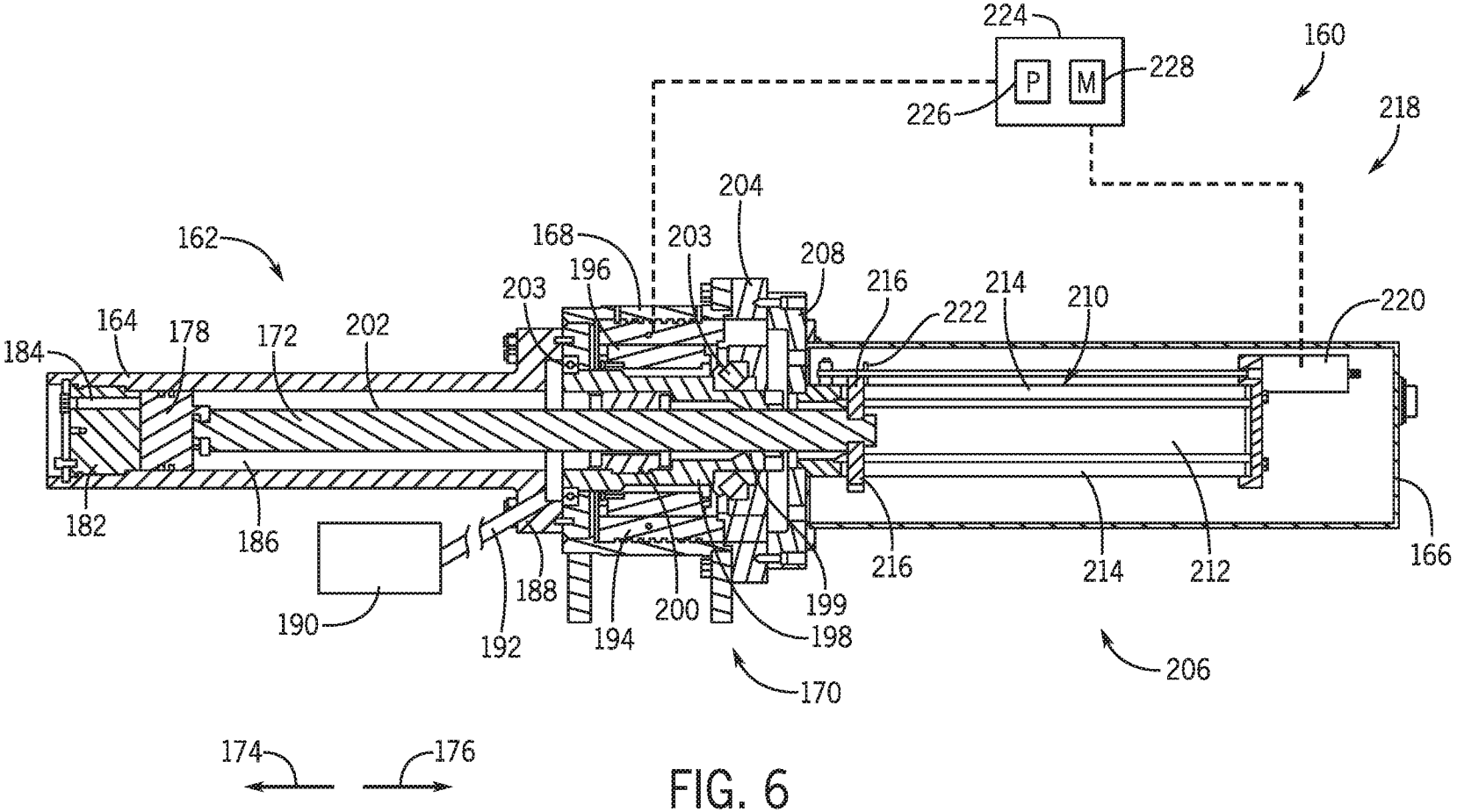
FIG. 6 is a cross-sectional view along line 5-5 in FIG. 4 of the accumulator system in an actuated state, in accordance with an embodiment of the present disclosure.

FIG. 6 is a cross-sectional view along line 5-5 in FIG. 4 of the accumulator system 160 in an actuated state. As explained above, the accumulator system 160 transitions from the unactuated state to the actuated state as the actuator 170 rotates. Rotation of the actuator 170 rotates the screw adapter 198, which rotates the roller screws 200 to drive the shaft 172 in direction 174. As the shaft 172 moves in direction 174, the shaft 172 drives the piston 178. Movement of the piston 178 in direction 174 pressurizes and drives the working fluid out of the accumulator system 160. As the working fluid exits, the working fluid may actuate a mineral extraction system and/or component.

Technical effects of the disclosed embodiments include an accumulator system that does not rely on pressurized gas to provide power to a working fluid. The accumulator system may therefore not experience a loss in efficiency due to water depth. The accumulator system may also vary pressure output since the electric actuator may be controlled in response to pressure demands of the mineral extraction system or component.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments.

However, the illustrative discussions above are not intended to be exhaustive or to limit the disclosure to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principals of the disclosure and its practical applications, to thereby enable others skilled in the art to best utilize the disclosure and various embodiments with various modifications as are suited to the particular use contemplated.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An accumulator system, comprising:

a housing, the housing defining a function chamber and a balance chamber;

a piston configured to move axially within the housing, the piston configured to separate the function chamber from the balance chamber;

an electric actuator configured to couple to and drive the piston within the housing to compress and drive a first fluid out of the function chamber;

a battery within the housing and coupled to the electric actuator;

a shaft coupled to the piston and to the electric actuator, wherein the shaft is coupled to the electric actuator with a screw adapter, the screw adapter defining an aperture that enables the shaft to extend through the screw adapter, and wherein rotation of the screw adapter is configured to drive the piston axially; and an anti-rotation system comprising:

an anti-rotation housing defining a cavity; and a plurality of anti-rotation guides, wherein the shaft is received in the cavity of the anti-rotation housing, and wherein the plurality of anti-rotation guides blocks rotation of the shaft.

2. The accumulator system of claim 1, wherein the electric actuator is within the balance chamber.

3. The accumulator system of claim 1, wherein the balance chamber is configured to receive a second fluid as the piston moves in a first direction and to discharge the second fluid as the piston moves in a second direction opposite the first direction.

4. The accumulator system of claim 1, wherein, the electric actuator includes an electric motor including a rotor and a stator, each of the rotor and the stator being disposed in the balance chamber.

5. An accumulator system, comprising:

an accumulator system housing, the accumulator system housing defining a function chamber and a balance chamber;

a piston configured to move axially within the accumulator system housing, the piston configured to separate the function chamber from the balance chamber;

an electric actuator housed in an actuator housing, the electric actuator being configured to couple to and drive the piston within the accumulator system housing to compress and drive a first fluid out of the function chamber;

a shaft configured to couple to the piston and to the electric actuator, wherein the shaft couples to the electric actuator with a screw adapter, and wherein rotation of the screw adapter is configured to drive the piston axially;

a plurality of roller screws configured to couple directly to the shaft and to the screw adapter, wherein the roller screws are configured to transfer rotation of the screw adapter to axially move the shaft;

an anti-rotation housing defining a cavity and at least one slit; and at least one anti-rotation guide, wherein the shaft is received in the cavity of the anti-rotation housing, and wherein the at least one anti-rotation guide extends into the at least one slit to block rotation of the shaft by contacting the anti-rotation housing.

6. The accumulator system of claim 5, wherein the electric actuator is within the balance chamber.

7. The accumulator system of claim 5, wherein the balance chamber is configured to receive a second fluid as the piston moves in a first direction and to discharge the second fluid as the piston moves in a second direction opposite the first direction.

8. The accumulator of claim 5, wherein, the electric actuator includes an electric motor including a rotor and a stator, each of the rotor and the stator being disposed in the balance chamber.

9. A mineral extraction system, comprising:

a mineral extraction component;

an accumulator system coupled to the mineral extraction component, wherein the accumulator system is configured to pressurize a fluid to actuate the mineral extraction component, the accumulator system comprising:

a housing, the housing defining a function chamber and a balance chamber;

a piston configured to move axially within the housing, the piston configured to separate the function chamber from the balance chamber;

an electric actuator configured to couple to and drive the piston within the housing to compress and drive a first fluid out of the function chamber, the electric actuator including an electric motor including a rotor and a stator, and each of the rotor and the stator being disposed in the balance chamber;

a shaft configured to couple to the piston and to the electric actuator, wherein the shaft couples to the electric actuator with a screw adapter, the screw adapter defining an aperture that enables the shaft to extend through the screw adapter, and wherein rotation of the screw adapter is configured to drive the piston axially, an anti-rotation housing that receives the shaft; and at least one anti-rotation guide that blocks rotation of the shaft by contacting the anti-rotation housing, wherein the mineral extraction component is a blowout preventer.

10. The mineral extraction system of claim 9, wherein the balance chamber is configured to receive a second fluid as the piston moves in a first direction and to discharge the second fluid as the piston moves in a second direction opposite the first direction.

11. The mineral extraction system of claim 9, further comprising a position detection system configured to detect a position of the shaft.

12. The mineral extraction system of claim 11, wherein the position detection system comprises a magnetic field sensor or an ultrasonic sensor.

* * * * *